US006595593B2

(12) United States Patent
Elam

(10) Patent No.: US 6,595,593 B2
(45) Date of Patent: Jul. 22, 2003

(54) LOCKING MECHANISM SUITABLE FOR USE IN OFFICE TYPE CHAIRS

(75) Inventor: Michael Elam, Runnymede (GB)

(73) Assignees: Alan Glaser, Greenford (GB); Lesley Glaser, Greenford (GB)

( * ) Notice: Subject to any disclaimer, the term of this patent is extended or adjusted under 35 U.S.C. 154(b) by 0 days.

(21) Appl. No.: 09/921,154

(22) Filed: Aug. 2, 2001

(65) Prior Publication Data

US 2002/0014798 A1 Feb. 7, 2002

(30) Foreign Application Priority Data

Aug. 4, 2000 (GB) ..... 0019133

(51) Int. Cl.[7] ..... A47B 97/00; E05C 3/06

(52) U.S. Cl. ..... 297/463.1; 297/313; 297/302.1; 292/217

(58) Field of Search ..... 297/313, 302.1, 297/463.1, 354.1, 354.12; 74/502, 501.6, 501.5 R, 567; 292/DIG. 4, 217

(56) References Cited

U.S. PATENT DOCUMENTS

| | | | | | |
|---|---|---|---|---|---|
| 3,522,970 | A | * | 8/1970 | Francis | 297/335 |
| 4,304,384 | A | * | 12/1981 | Cremer et al. | 248/397 |
| 5,203,532 | A | * | 4/1993 | Matsuura | 248/394 |
| 5,217,262 | A | * | 6/1993 | Kurosaki | 292/6 |
| 5,785,362 | A | * | 7/1998 | Nadherny | 292/98 |
| 6,247,733 | B1 | * | 6/2001 | Weiland | 292/228 |

* cited by examiner

*Primary Examiner*—Peter M. Cuomo
*Assistant Examiner*—Sarah C. Burnham
(74) *Attorney, Agent, or Firm*—Stroock & Stroock & Lavan LLP

(57) ABSTRACT

A locking mechanism (11) suitable for use with office type chairs comprising an operating lever (13) movable between a locking position in which locking takes place and an unlocking position in which unlocking takes place, a spring, which biases the lever (13) into the locking position and a catch (23, 27, 29), which holds the lever (13) in the unlocking position upon movement of the lever (13) into the unlocking position. The catch (23, 27, 29) is disengaged when the lever (13) moves past the unlocking position. Upon disengagement of the catch, the lever (13) returns to the locking position under the action of the spring.

20 Claims, 9 Drawing Sheets

9
1
3
13
17
15
11
7
5

LOCKING MECHANISM SUITABLE FOR USE IN OFFICE TYPE CHAIRS

CROSS REFERENCE TO RELATED APPLICATION

This claims the benefit of United Kingdom Patent Application No. 0019133.8, filed Aug. 4, 2000.

BACKGROUND OF THE INVENTION

This invention relates to a locking mechanism suitable for use in office type chairs.

Office type chairs are commonly provided with various adjustment possibilities, the most common being the height of the seat, the angle of the seat portion and the rake of the seat back. This adjustment is often carried out using spring biased levers, located at one side of the seat, one for each type of adjustment. The way in which this usually operates is that, to adjust a particular feature, the lever associated with that feature is raised, or sometimes lowered, against the action of the spring to unlock the adjustment means. It is necessary to hold the lever against the action of the spring during adjustment as release of the lever will allow it to return to the locked position, thus locking the feature against further movement. Because of the nature of the device being adjusted, it is necessary to have a strong spring as it is necessary to ensure that the seat feature remains locked in use. Unlocking of the seat while in use could cause accidents.

Difficulty, arises in carrying out adjustments because of the need to hold the lever against the spring while manoeuvring the chair feature into the desired position.

The present invention seeks to avoid this problem by enabling adjustments to be made without the need for holding the lever while making adjustments.

SUMMARY OF THE INVENTION

According to the invention, there is provided a locking mechanism suitable for use with office type chairs comprising an operating lever movable between a first position in which locking takes place and a second position in which unlocking takes place, spring means for biasing the lever into said first or locking position and catch means for holding the lever in said second or unlocked position on movement of the lever into said second position, the catch means being disengageable by movement of the lever past said second or unlocking position allowing the lever to return to said first or locking position under the action of the spring means.

Preferably, the catch means comprises a cam element rotatable with the lever and having a stop surface engageable by a lock element to prevent return of the lever to its locking position, release means being provided to disengage the lock element from the stop surface on movement of the lever past the unlocking position.

The stop surface may comprise a step in the cam surface and the lock element comprises a detent engageable with the step.

The release means may comprise a slider, slidable in a circumferential slot in the cam element, the slider having a projection engageable with the detent to move the detent away from the cam element when entrained by one end of the slot during the movement of the lever past the unlocking position. The length of the slot may be such that when the lever is in its locking position and the slider is entrained by the other end of the slot, the projection of the slider is disengaged from the detent.

Alternatively, the stop surface may comprise a hook located on a surface of the cam and the lock element comprises a pin element engageable in the hook.

In this case, the release means may comprise a second pin element constrained to move with the first pin element and movable by another surface of the cam on appropriate movement of the cam to disengage the first pin element from the hook.

The cam may be provided with a recessed portion having the hook at the base thereof co operating with the first pin and an Island structure located outwards of the base and co operating with the second pin.

An exterior slider arrangement may be provided having a slider or detent engageable with a step on an outer surface of the cam in the unlocked position of the lever.

BRIEF DESCRIPTION OF THE DRAWINGS

The invention will now be described in greater detail, by way of example, with reference to the drawings, in which.

DESCRIPTION OF THE PREFERRED EMBODIMENT

Figure 1:
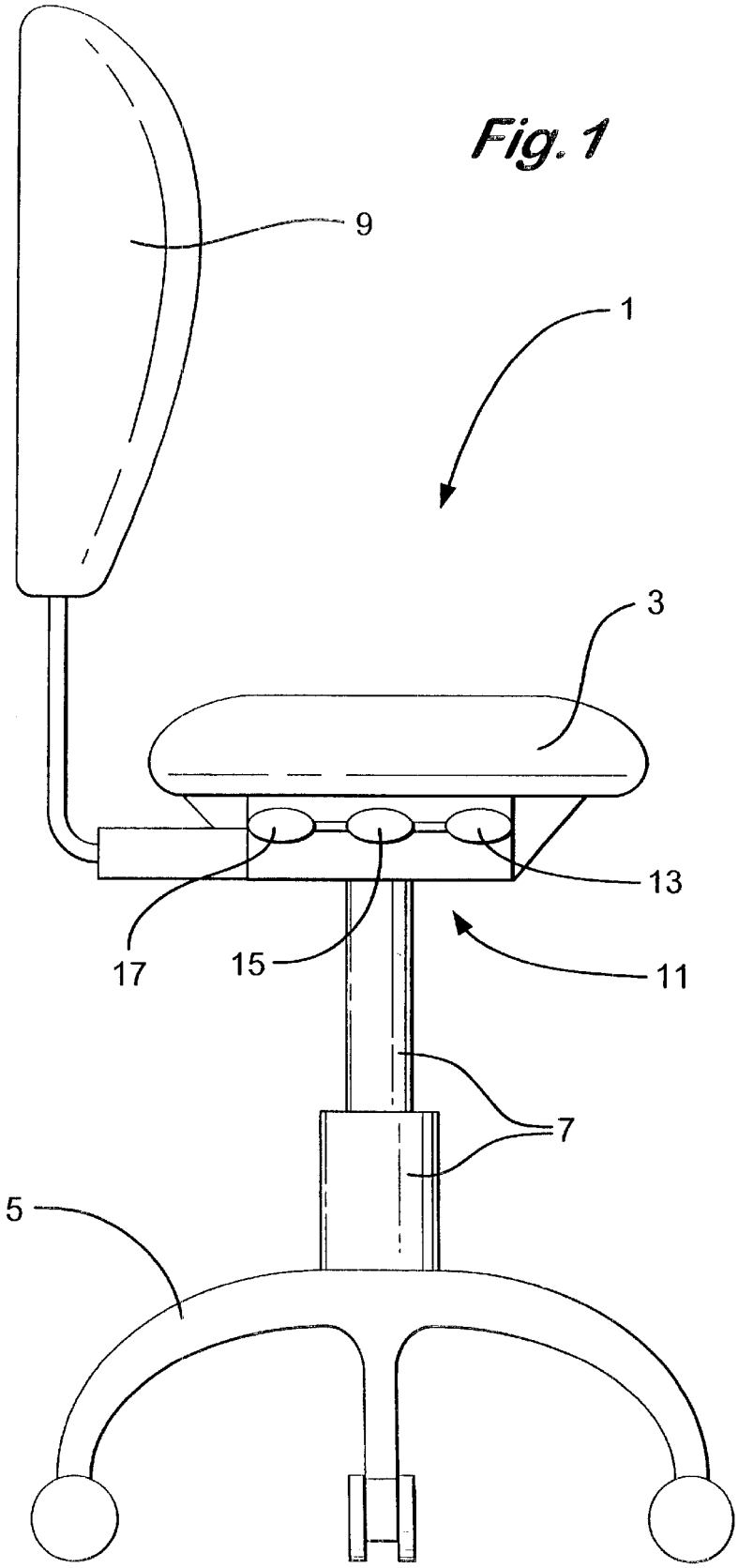
FIG. 1 is a side diagrammatic view of an office type chair to which one embodiment of the invention is applied.

Referring to FIG. 1, there is shown in diagrammatic side view an office type chair 1. It comprises a seat 3 mounted on a roller frame 5 by means of a telescopic height adjuster 7. The seat 3 is adjustable so as to be pivotally adjustable so as to adjust between a generally horizontal position and a forward tilting position. The seat 1 also has a back rest 9 which is adjustable for rake.

Control of the three types of adjustment is carried out by a three lever arrangement 11 of which the first lever 13 provides for seat portion tilt, the second lever 15 provides for seat height and the third lever 17 provides for back rake. The present chair is provided with a locking arrangement in accordance with the invention in connection with the first lever 13 although it will be understood that the invention could equally be applied to any of the levers or to all of them. The lever 13 is selected in the present situation as this is believed to be the operation which is most difficult to perform adequately of the three.

Figure 2:
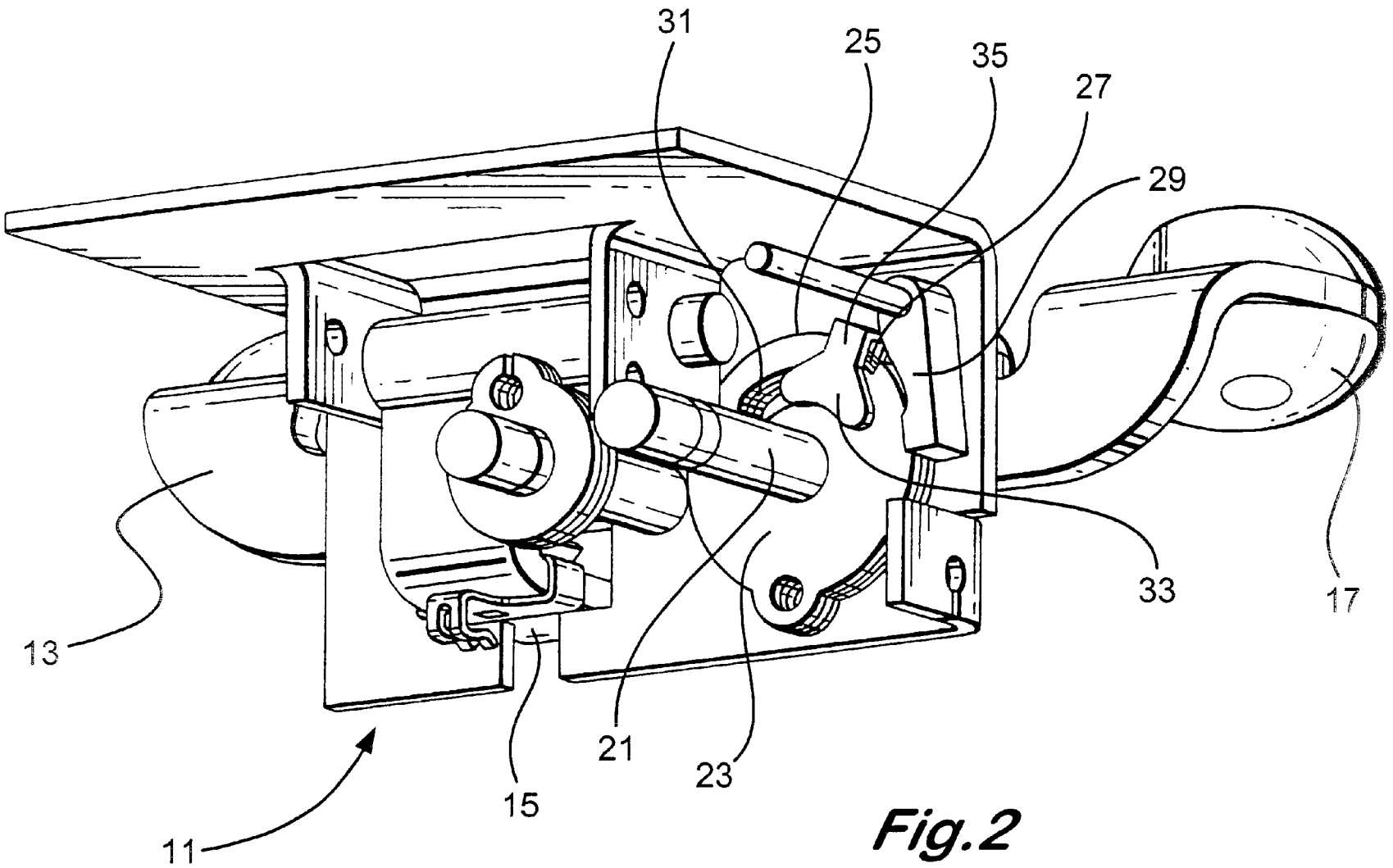
FIG. 2 is a perspective view of the chair locking mechanisms in which the invention is applied to one of the mechanisms.

FIG. 2 shows a perspective view of the three lever mechanism 11 of which only the mechanism of the lever 13 will be considered. It is to be observed that neither the connection between the mechanism and the feature being controlled, usually a bowden cable or the like, nor the spring for biasing the lever 13 are shown for the sake of clarity.

As can be seen, the lever 13 is connected to pivot about an axle 21 with which it moves and which carries a rotary cam element 23, also tied to the movement of the lever 13.

The cam element 23 has a cam surface 25 provide with a step 27 which co-operates with a spring urged detent 29 as will be described hereafter. The cam element 23 also has a circumferentially extending slot 31 in which is located a slider 33 freely slidable therein. The slider 33 has a projection 35 which also interacts with the detent 29.

Figure 3:
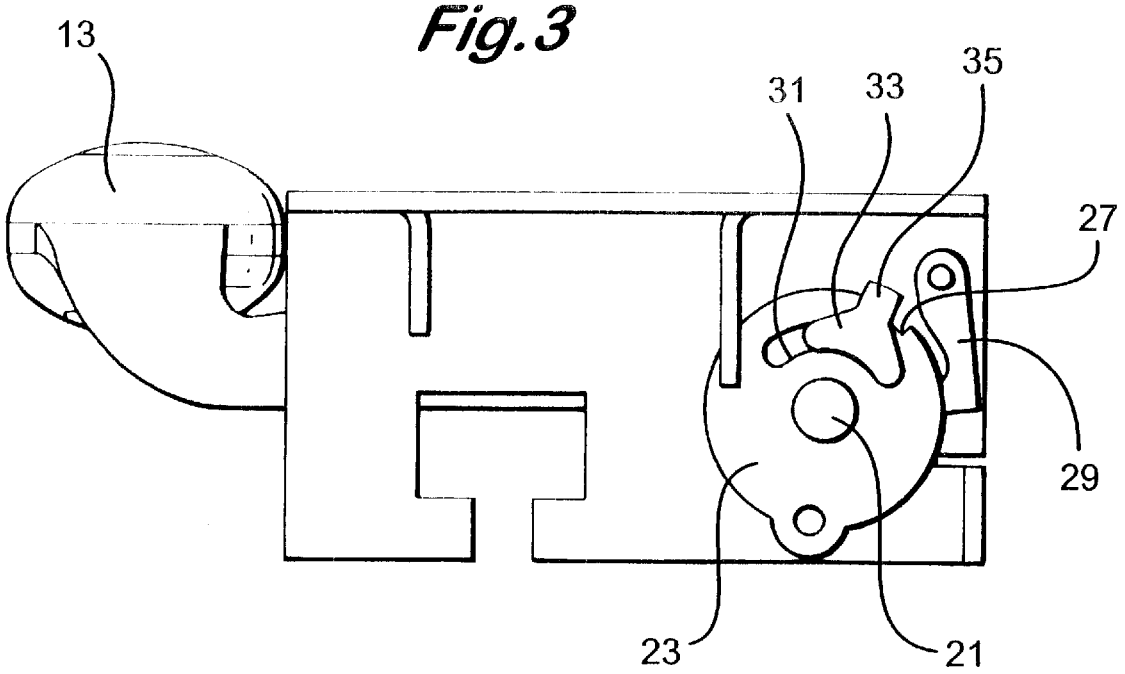
FIGS. 3 to 7 are views of a locking mechanism in accordance with one embodiment of the invention showing various stages of its operation.

The operation of the mechanism will now be describe with reference to FIGS. 3 to 7:

FIG. 3 shows the lever 13 in the locked position. In this position, the cam element 23 is positioned with its step 27 above the detent 29 so that the detent rides on the high part of the cam 23. The lever 13 is retained in this position by a biasing spring (not shown). The slider 33 is located in the clockwise end of the slot 31.

Figure 4:
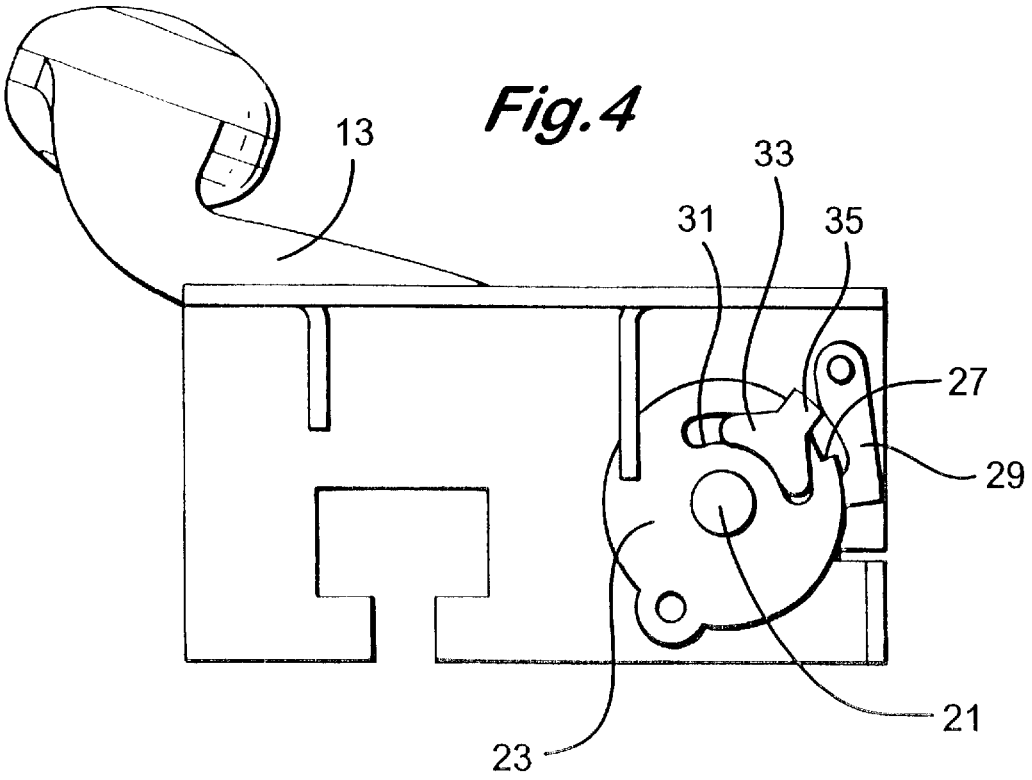

In order, to unlock the seat tilting mechanism, the lever 13 is raised through the position shown in FIG. 4 where it will be seen that the cam element 23 has rotated clockwise and the projection 35 of the slider 33 has engaged the detent 29 and is starting to move anticlockwise in the slot 31.

Figure 5:
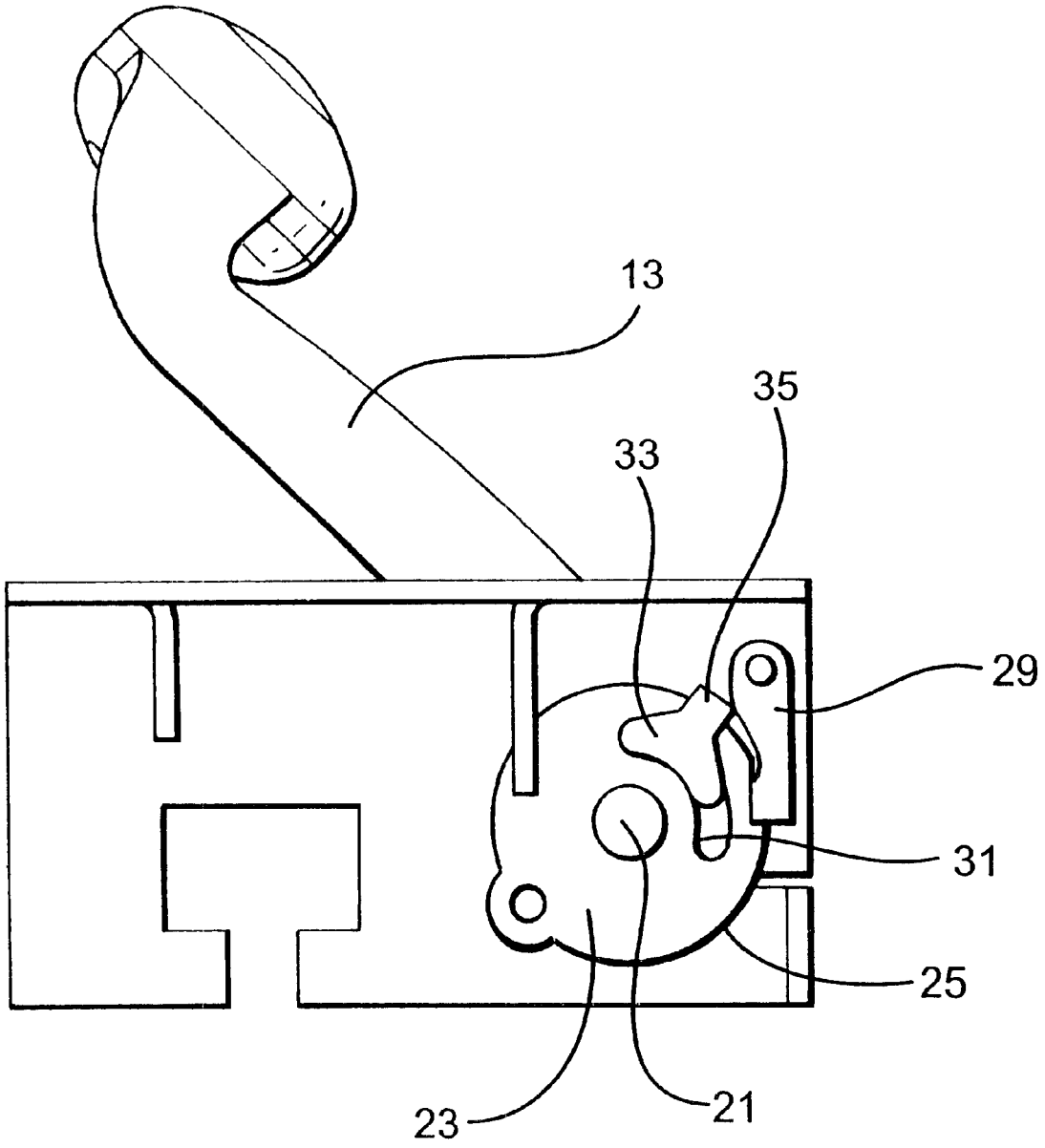
Figure 6:
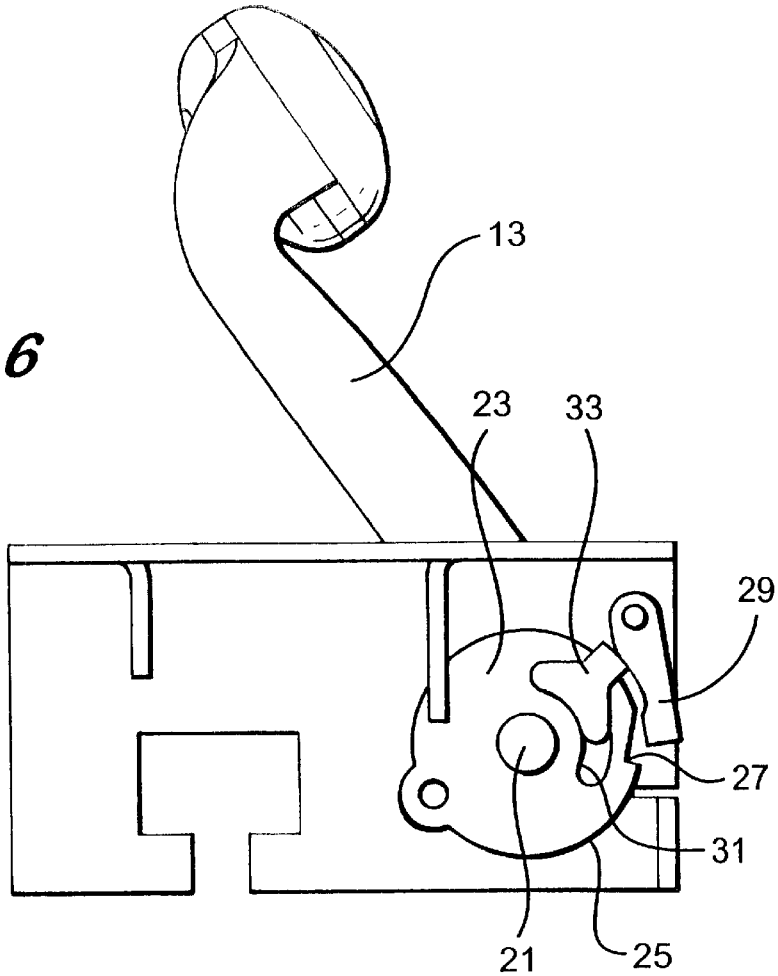

In FIG. 5, the lever has reached its unlocking position. In this position, the detent 29 has passed over the step 27 so as to engage behind it, thus preventing a return of the lever 13 to its locking position. At this time also, the slider 33 has been pushed back to the anticlockwise end of the slot 31.

Figure 7:
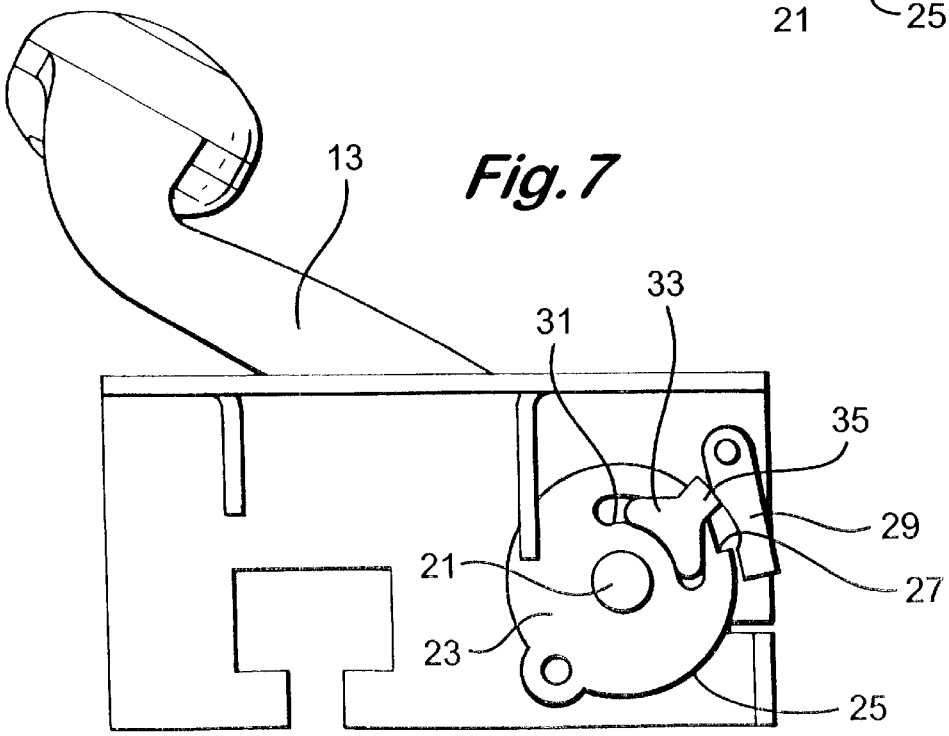

Having attained this position, the lever 13 can be released and the position of the chair seat 3 can be adjusted. Once the desired adjustment of the seat 3 has been achieved, the lever 13 is released to return to its locking position as shown in FIG. 3. To achieve this, the lever 13 is raised still further, again rotating the cam element 23 clockwise. The projection 35 of the slider 33 remains in contact with the detent 29 but the slider 33 cannot be moved any further anticlockwise. Instead, it is moved clockwise by the end of the slot 31, forcing the detent 29 outwards away from the cam element 23, releasing it and permitting anticlockwise movement of the lever 13 under the action of its spring to its locking position shown in FIG. 6. In passing to this position, the engagement of the projection 35 of the slider on the detent 29 causes the slider 33 to remain stationary and thus be repositioned at the clockwise end of the slot 31 (FIG. 7).

At this point, the slider 33 is again entrained by the slot 31 to move anticlockwise and the projection 35 disengages from the detent 29, allowing the detent 29 to reengage the surface 25 of the cam element 23.

FIGS. 8 to 14 show a second embodiment of the invention.

Figure 8:
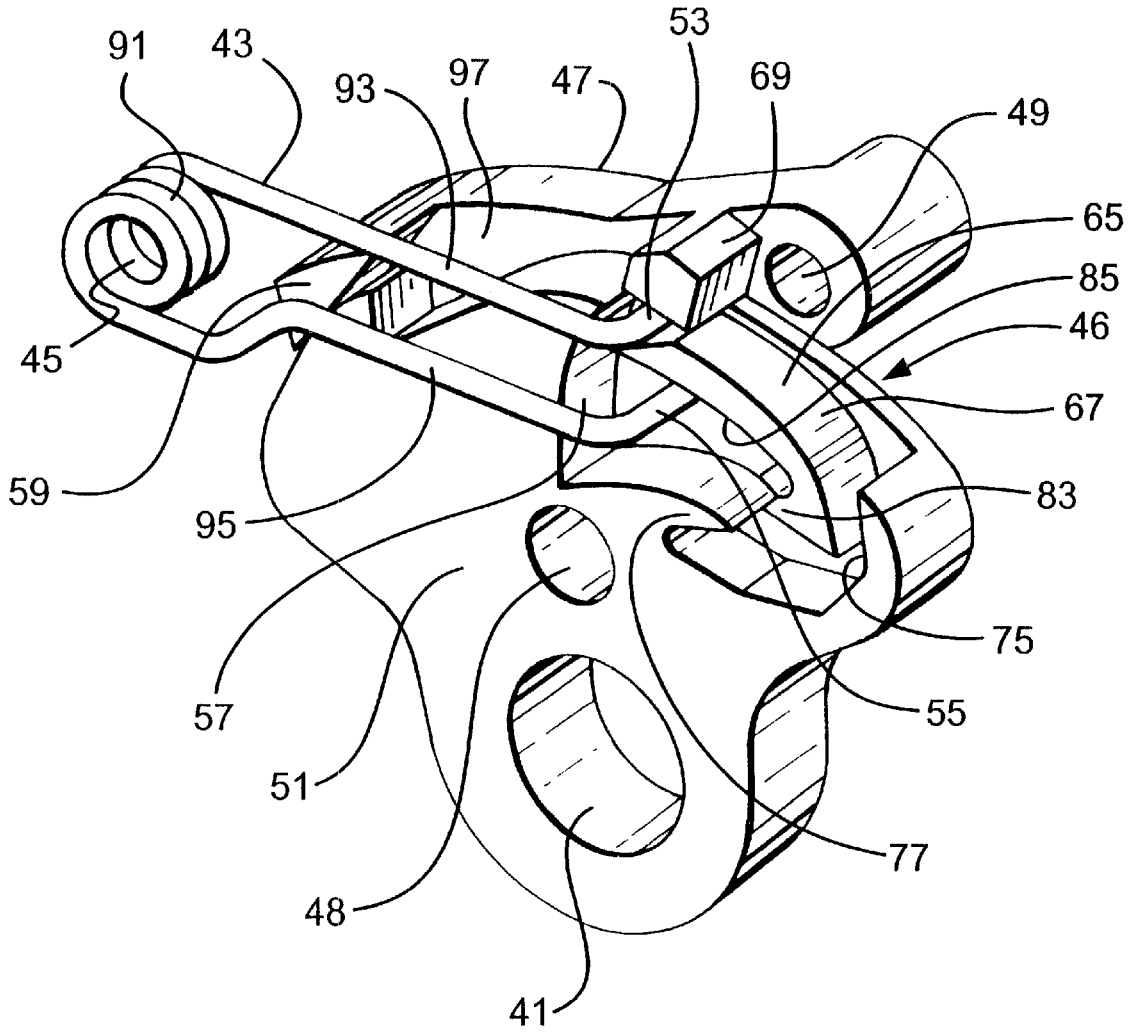
FIG. 8 is a perspective view of the elements of a second form of locking mechanism in accordance with the invention.

FIG. 8 shows a perspective view of the elements of a second locking mechanism in accordance with the invention. here only the parts actually involved in the locking are shown. Thus the mechanism basically comprises three parts viz: a cam 51 pivoted about a pivot bore 41, a spring urged pin assembly 43 pivoted about a bore 45 and a pivoted slider arrangement 47 pivoted about a bore 49.

The lever 13 (FIGS. 9 to 14) is constrained to pivot about the same axis as the cam 51 and to move therewith.

The cam has an outer surface having a detent recess 81 thereon. It also has a recessed portion 46 in which are located a cam island 67 with upper and lower edges 65 and 85 respectively. At the right hand end of the cam island 67 is a hook recess 83. The base portion of the cam recess also has a hook recess 77. The cam, recess has a left hand side wall 57 and a right hand side wall 75. The cam also has a bore 48 to receive the end of a Bowden cable 79 as can best be seen in FIGS. 9 to 14. This Bowden cable 79 acts to provide locking and unlocking of the chair feature to be adjusted in known manner.

The spring urged pin assembly comprises a wire element having a spring part 91. two arms 93 and 95 ending in right angle bends to form two pins 53 and 55 which co-operate with the various parts of the cam recess 46 as will be described hereafter.

The pivoted slider arrangement 47 comprises an arm 97 pivoted about a bore 49 and urged against the surface of the cam 51 by spring means (not shown). It carries a stop 69 adjacent to the bore 49 and a slider 59 at its free end.

Figure 9:
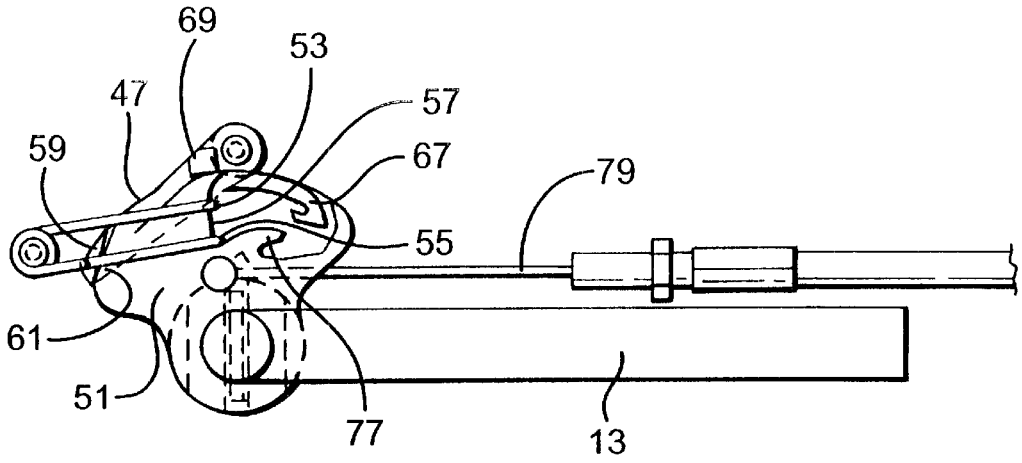
FIGS. 9 to 14 are views of the locking mechanism depicted in FIG. 8 showing various stages of its operation.

The operation of the mechanism will now be describe with reference to FIGS. 9 to 14:

FIG. 9 shows the lever 13 in the locked position. In this position, the cam element 51 is in its most clockwise position with both pins 53 and 55 against the left hand wall 57 thereof and the slider 59 is sliding on the high part 61 of the cam element 51. The cam element 51 from is then in its most clockwise position. The lever 13 is retained in this position by a biasing spring (not shown).

Figure 10:
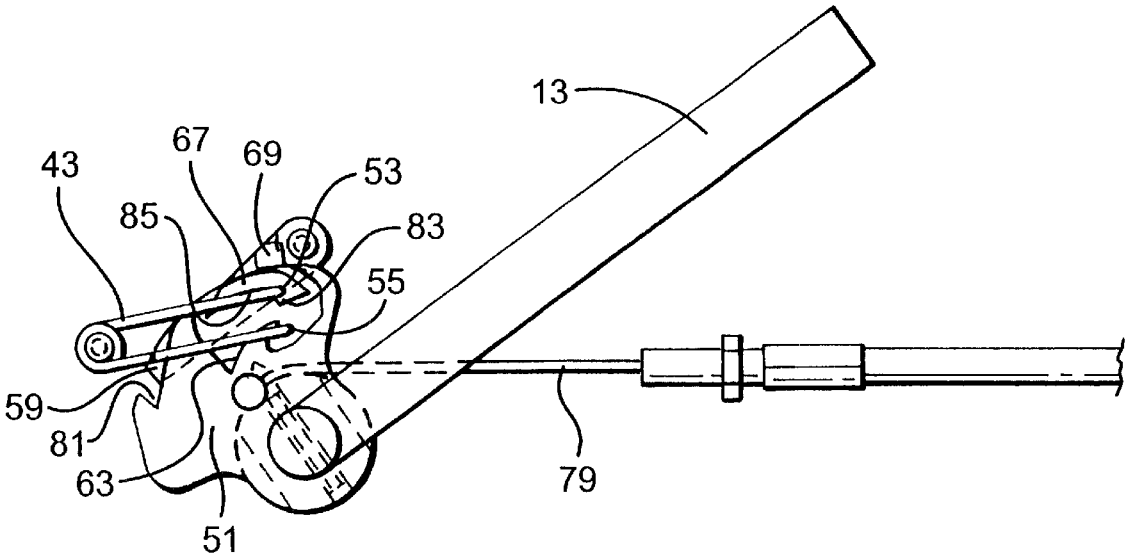

In order to unlock the seat tilting mechanism, the lever 13 is raised through the position shown in FIG. 10 where it will be seen that the cam element 51 has rotated anticlockwise thereby and the second pin 55 has slid rightwards along the surface 63 on the lower surface of the cam recess 46 and caused the upper pin 53 to be raised upwards and passed forward into the recess 83 in the cam island. The lower pin 55 has moved past the end of the surface 63. In this position, the slider 59 of the slider arrangement 47 will have dropped into the detent recess 81 and will prevent any significant return movement of the lever 13.

Figure 11:
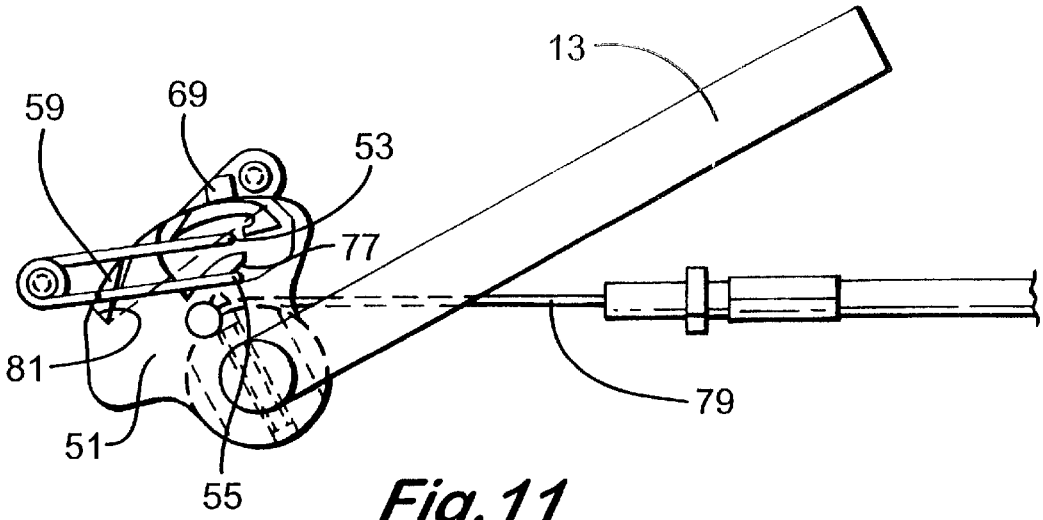

Release of the lever 13 will cause it to move clockwise causing the lower pin 55 to enter the hook recess 77 and prevent further clockwise movement, locking the mechanism in this position as shown in FIG. 11. The upper pin 53 will also drop out of the recess 83, leaving it free. At the same time, the slider 59 will also be brought up against the shoulder of the detent recess 81 so as to assist the prevention of clockwise movement of the cam 61

With the lever 13 in this position, adjustment of the chair can take place.

Figure 12:
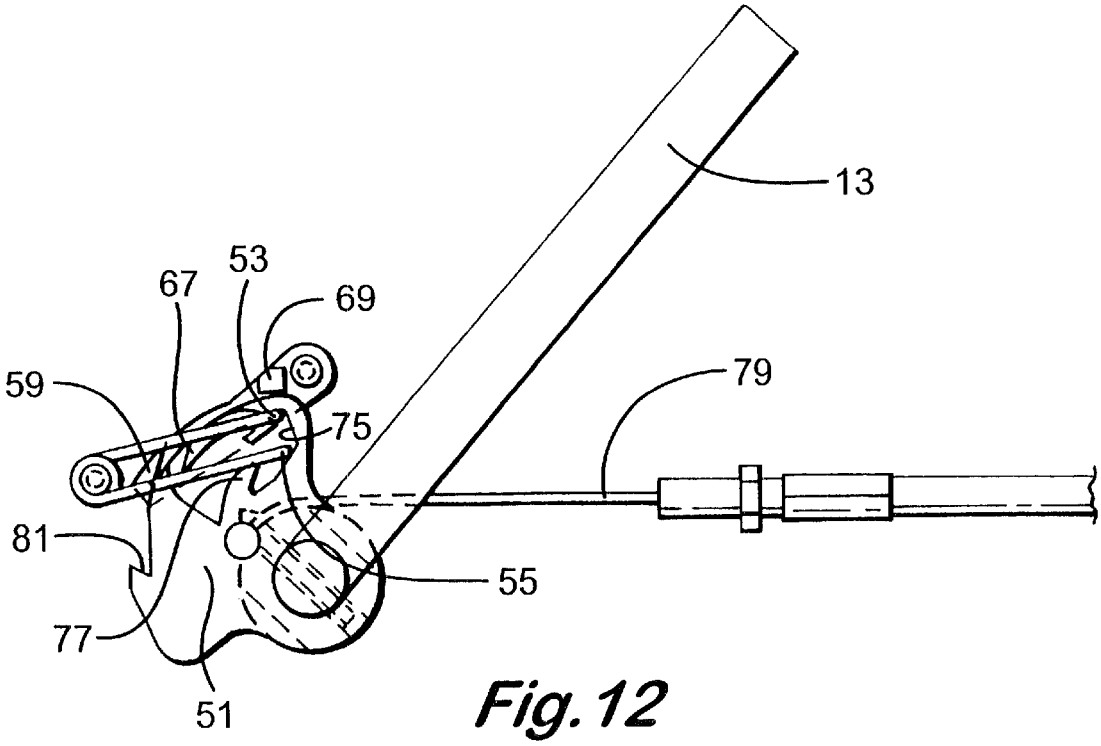
Figure 13:
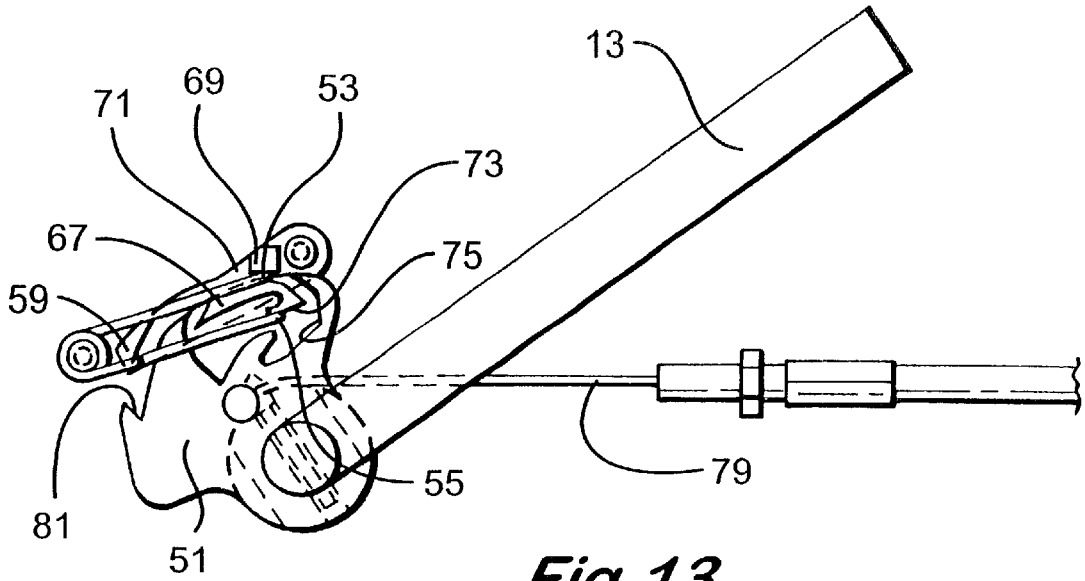

To move the lever 13 back to its locking position once adjustment of the chair has taken place, the lever 13 is again raised slightly moving the lower pin 55 out of the hook recess 77 and, as a result, moving the upper pin 53 along the underside of the cam island 67 so as to clear it. Further upward movement of the lever 13 moves the lower pin 55 along the bottom surface of the cam recess 46 raising the upper pin 53 around the end of the cam island 67 so as to engage the upper surface thereof (FIG. 12). At the same time, the slider 59 moves out of the detent recess 81.

Release of the lever 13 at this point will cause it to move down under the action of its spring and rotate the cam 61 clockwise. The pin 53 moves along the upper surface of the cam island 67 engaging the stop 69 and raising the slider 59 into a position (FIG. 13) in which it is clear of the detent recess 81.

Figure 14:
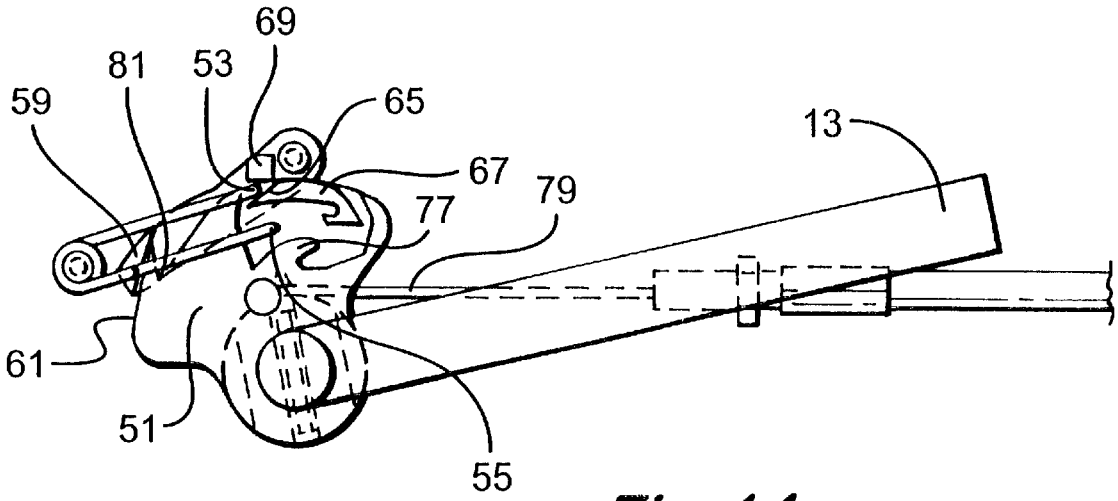

The released lever 13 continues to move downwards, further rotating the cam 61 clockwise. The upper pin 53 moves along the upper surface of the cam island, still maintaining the stop 69 in its raised position so that the slider 59 again engages the outer surface of the cam 61 beyond the detent recess 81 as shown in FIG. 14.

Finally, the lever returns to its starting position as shown in FIG. 9 with the two pins 53 and 55 engaging the leftward wall 57 of the cam recess 46, thus preventing any further clockwise movement of the cam 61 and thus also the lever 13.

It will be appreciated that various modifications or additions may be made to the above described embodiment without departing from the scope of the invention. For example, the operation of the mechanism could be reversed, with the lever operation being downwards instead of upwards.

In the second embodiment, the pins 53 and 55 could be mounted on a pivotally arranged biased plate. Also, it will be appreciated that the slider arrangement 47 is not essential to the operation of the mechanism and merely provides additional strength. It can therefore be omitted in some circumstances.

Furthermore, while the mechanism has been described for use with an office type chair, it will be understood that the mechanism could be applied in other situations where a locking mechanism of this type would be useful.

What is claimed is:

1. A locking mechanism suitable for use with office type chairs comprising an operating lever movable to a locking position in which locking takes place and to an unlocking position in which unlocking takes place; a spring mechanism, which biases said lever into said locking position; and a catch mechanism, positioned through movement of said lever, which holds said lever in said unlocking position upon movement of said lever into said unlocking position, said catch mechanism being disengaged upon movement of said lever from said unlocking position, the disengagement of said catch mechanism allowing said lever to return to said locking position under the action of said spring mechanism.

2. A locking mechanism suitable for use with office type chairs comprising an operating lever movable to a locking position in which locking takes place and to an unlocking position in which unlocking takes place; a spring mechanism, which biases said lever into said locking position; and a catch mechanism, positioned through movement of said lever, which holds said lever in said unlocking position upon movement of said lever into said unlocking position, said catch mechanism being disengaged upon movement of said lever from said unlocking position, the disengagement of said catch mechanism allowing said lever to return to said locking position under the action of said spring mechanism, wherein said catch mechanism comprises a cam element rotatable with said lever and having a stop surface engageable by a lock element to prevent return of said lever to its said locking position, and a release mechanism disengaging said lock element from said stop surface on movement of said lever past said unlocking position.

3. The mechanism of claim 2, wherein said stop surface comprises a step in said cam surface and said lock element comprises a detent engageable with said step.

4. The mechanism of claim 3, wherein said release means comprises a slider, sliding in a circumferential slot in said cam element, and a projection on said slider engaging said detent to move said detent away from said cam element when entrained by one end of said slot during the movement of said lever past said unlocking position.

5. The mechanism of claim 4, wherein said slot comprises two ends and a length adapted, when said lever is in its said locking position and said slider is entrained by the one said end of said slot, said projection of said slider is disengaged from said detent.

6. The mechanism of claim 2, wherein said stop surface comprises a hook located on a surface of said cam and said lock element comprises a pin element engaging in said hook.

7. The mechanism of claim 6, wherein said mechanism also comprises an exterior slider arrangement, said slider arrangement comprising a detent engageable with a step on an outer surface of said cam in said unlocking position of said lever.

8. The mechanism of claim 6, wherein said release means comprises a second pin element constrained to move with said first pin element and moved by another surface of said cam on appropriate movement of said cam to disengage said first pin element from said hook.

9. The mechanism of claim 8, wherein said mechanism also comprises an exterior slider arrangement, said slider arrangement comprising a detent engageable with a step on an outer surface of said cam in said unlocking position of said lever.

10. The mechanism of claim 9, wherein said cam comprises a recessed portion having a base with said hook at said base co-operating with said first pin and an Island structure located outwards of said base and co operating with said second pin.

11. The mechanism of claim 10, wherein said mechanism also comprises an exterior slider arrangement, said slider arrangement comprising a detent engageable with a step on an outer surface of said cam in said unlocking position of said lever.

12. A mechanism as claimed in claim 1, wherein said catch mechanism comprises a cam element rotatable with said lever, said cam element having a stop surface engageable by a lock element, said cam being rotatable to hold said lever in said unlocking position, and being rotatable to disengage said lock element from said stop surface on movement of said lever from said unlocking position.

13. A mechanism as claimed in claim 12, wherein said stop surface comprises a hook located on a surface of said cam and said lock element comprises a pin element engaging in said hook.

14. A mechanism as claimed in claim 13, further comprising an exterior slider arrangement, which includes a detent engageable with a step on an outer surface of said cam upon movement of said cam said unlocking position.

15. A mechanism as claimed in claim 14, wherein said mechanism also comprises an exterior slider arrangement that includes a detent engageable with a step on an outer surface of said cam in said unlocking position of said lever.

16. A multi-directional locking mechanism suitable for use with office type chairs comprising, for a plurality directions: one or more operating levers movable to a locking position in which locking of the chair against movement in the respective direction takes place and to an unlocking position in which unlocking of the chair for movement in the respective direction takes place; a plurality of spring mechanisms, each of which biases one said lever into said locking position for said respective direction; and a plurality of catches, each being positioned through movement of said respective lever, which hold said respective levers in said unlocking position upon movement of said lever into said unlocking position, with each said catch mechanism being disengage upon movement of said respective lever from said unlocking position for said respective direction, whereby disengagement of each said respective catch allows said respective lever to return to said locking position for said respective direction under the action of its spring mechanism.

17. A multi-axial locking mechanism as claimed in claim 16, wherein said multi-axial locking mechanism includes three operating levers and controls positioning of the chair in three directions.

18. A multi-axial locking mechanism as claimed in 16, wherein at least one of said levers provides for seat portion tilt.

19. A multi-axial locking mechanism as claimed in 16, wherein at least one of said levers provides for seat height.

20. A multi-axial locking mechanism as claimed in 16, wherein at least one of said levers provides for back rake.

* * * * *